US011587697B2

(12) United States Patent
Peng et al.

(10) Patent No.: US 11,587,697 B2
(45) Date of Patent: Feb. 21, 2023

(54) FLAT CABLE ASSEMBLY

(71) Applicant: Dongguan Luxshare Technologies Co., Ltd, Dongguan (CN)

(72) Inventors: ZhongChao Peng, Dongguan (CN); JinChang Dai, Dongguan (CN); BenTao Hu, Dongguan (CN); HuanZhong Yan, Dongguan (CN); Andrew John Nowak, Milpitas, CA (US); Charles Lloyd Grant, Milpitas, CA (US)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/475,809

(22) Filed: Sep. 15, 2021

(65) Prior Publication Data

US 2022/0115162 A1 Apr. 14, 2022

(30) Foreign Application Priority Data

Oct. 9, 2020 (CN) ..... 202022228396.9

(51) Int. Cl.
*H01B 7/08* (2006.01)

(52) U.S. Cl.
CPC ..... *H01B 7/0807* (2013.01); *H01B 7/0823* (2013.01); *H01B 7/0838* (2013.01); *H01B 7/0861* (2013.01)

(58) Field of Classification Search
CPC .. H01B 7/0861; H01B 7/0838; H01B 7/0823; H01B 7/0807; H01B 11/1091
See application file for complete search history.

(56) References Cited

U.S. PATENT DOCUMENTS 4,185,162 A * 1/1980 Bogese, II ..... H01B 7/0838 174/32
6,677,518 B2 * 1/2004 Hirakawa ..... H01B 11/1091 174/36
10,964,448 B1 * 3/2021 Wright ..... H01B 3/421
2003/0150633 A1 * 8/2003 Hirakawa ..... H01B 11/002 174/36

(Continued)

FOREIGN PATENT DOCUMENTS

CN 107464610 A 12/2017

*Primary Examiner* — William H. Mayo, III
*Assistant Examiner* — Rhadames Alonzo Miller
(74) *Attorney, Agent, or Firm* — Birch, Stewart, Kolasch & Birch, LLP

(57) ABSTRACT

The application discloses a flat cable assembly, which includes a plurality of cables and an insulating film. The cables are arranged in a row and have a center line. The plurality of cables respectively have a first connecting portion and a second connecting portion symmetrically disposed with the first connecting portion, a signal wire and a grounding wire. The first connection portion is located on one side of the center line, and the second connection portion is located on the other side of the center line. The insulating film is provided on the first connection portion and the second connection portion of any one of the plurality cables. The two sides of the insulating film do not protrude outward from the two outermost cables, and the two surfaces of the insulating film in the direction perpendicular to the center line are planes.

17 Claims, 5 Drawing Sheets

(56) References Cited

U.S. PATENT DOCUMENTS

| | | | | |
|---|---|---|---|---|
| 2011/0247856 | A1* | 10/2011 | Matsuda | H01B 11/203<br>174/108 |
| 2012/0090873 | A1* | 4/2012 | Gundel | H01B 11/04<br>174/113 R |
| 2013/0146326 | A1* | 6/2013 | Gundel | H01B 11/1895<br>174/102 R |
| 2014/0182881 | A1* | 7/2014 | Huang | H01B 11/1091<br>174/103 |
| 2015/0294760 | A1* | 10/2015 | Gundel | H01B 11/002<br>174/102 R |
| 2018/0075948 | A1* | 3/2018 | Kobayashi | H01B 7/36 |
| 2018/0102204 | A1* | 4/2018 | Li | H01B 11/1808 |
| 2018/0158574 | A1* | 6/2018 | Dai | H01B 11/1856 |
| 2019/0096542 | A1* | 3/2019 | Huang | H01B 7/0838 |
| 2019/0172611 | A1* | 6/2019 | Sugiyama | H01B 7/0216 |
| 2019/0198199 | A1* | 6/2019 | Gundel | H01B 7/0838 |
| 2019/0318841 | A1* | 10/2019 | Hornung | H01B 11/1016 |
| 2020/0185124 | A1* | 6/2020 | Yang | H01B 7/0861 |

* cited by examiner

FLAT CABLE ASSEMBLY

CROSS-REFERENCE TO RELATED APPLICATIONS

The present application claims the benefit of the filing date of China Patent Application No 202022228396.9, filed Oct. 9, 2020, the disclosures of which are hereby incorporated by reference herein.

BACKGROUND

Technical Field

This present invention generally relates to the field of cable and, more particularly, to a flat cable assembly.

Related Art

A flat cable assembly includes several signal cables, two grounding wires and two insulating layers. The signal cables are arranged in a row, and the grounding wires are disposed on two lateral sides of the row of the signal cables. The insulating layers enclose the signal cables and the grounding wires so that each lateral side of the insulating layers must be provided with a protrusion respectively for securing the grounding wires. However, such a flat cable may cause a poor effect on EMI shielding (electromagnetic interference) and also must be manufactured by a more complicated process.

SUMMARY

The embodiments of the present invention provides a flat cable assembly to solve the problems of the poor effect on EMI shielding and the complicated manufacture process due to the separation of the grounding wires and the signal cables in the prior art.

In one embodiment, the flat cable assembly includes a plurality of cables and an insulating film. The cables are arranged in a row and having a central line, wherein each of the cables has a first connecting portion, a second connecting portion symmetrical with the first connecting portion, a signal wire and a grounding wire, the first connecting portion is located on one side of the central line, and the second connecting portion is located on the other side of the central line. The insulating film is disposed on the first connecting portion and the second connecting portion of one of the cables, wherein the insulating film has two sides without protruding from outermost ones of the cables, and has two flat surfaces having a normal line perpendicular to the central line.

In one embodiment, the flat cable assembly includes a plurality of cables and an insulating film. As for the flat cable assembly of the present disclosure, the grounding wires are integrated to each cable respectively, whereby the lateral sides of the insulating film do not extend outwards. Therefore, the manufacture process of the flat cable assembly of the present disclosure is simplified, and the flat cable assembly of the disclosure has excellent effect on EMI shielding and thus obtains excellent signal transmission.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Figure 1:
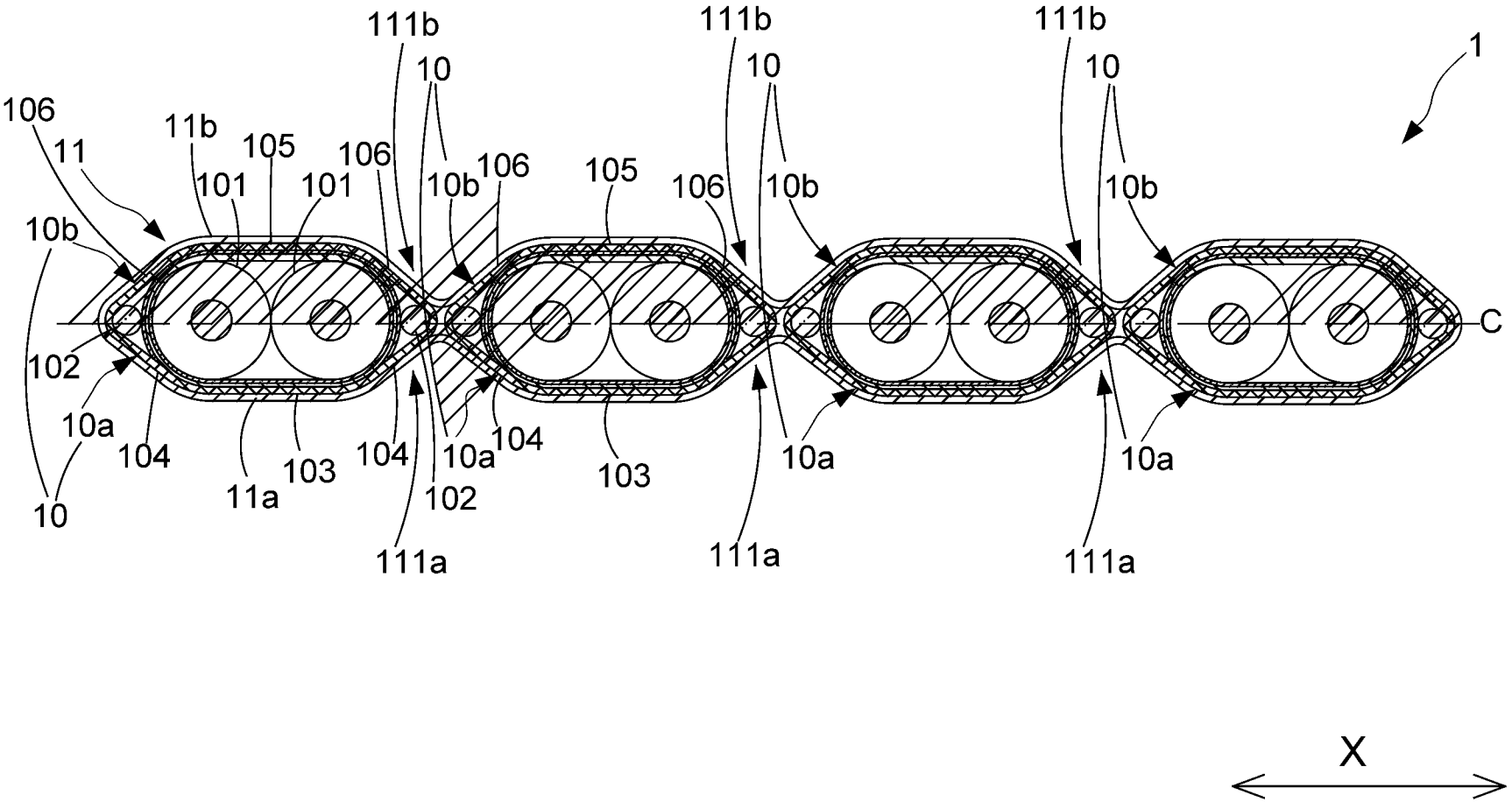
FIG. 1 is a schematic view of the first embodiment of a flat cable of the present application.
Figure 2:
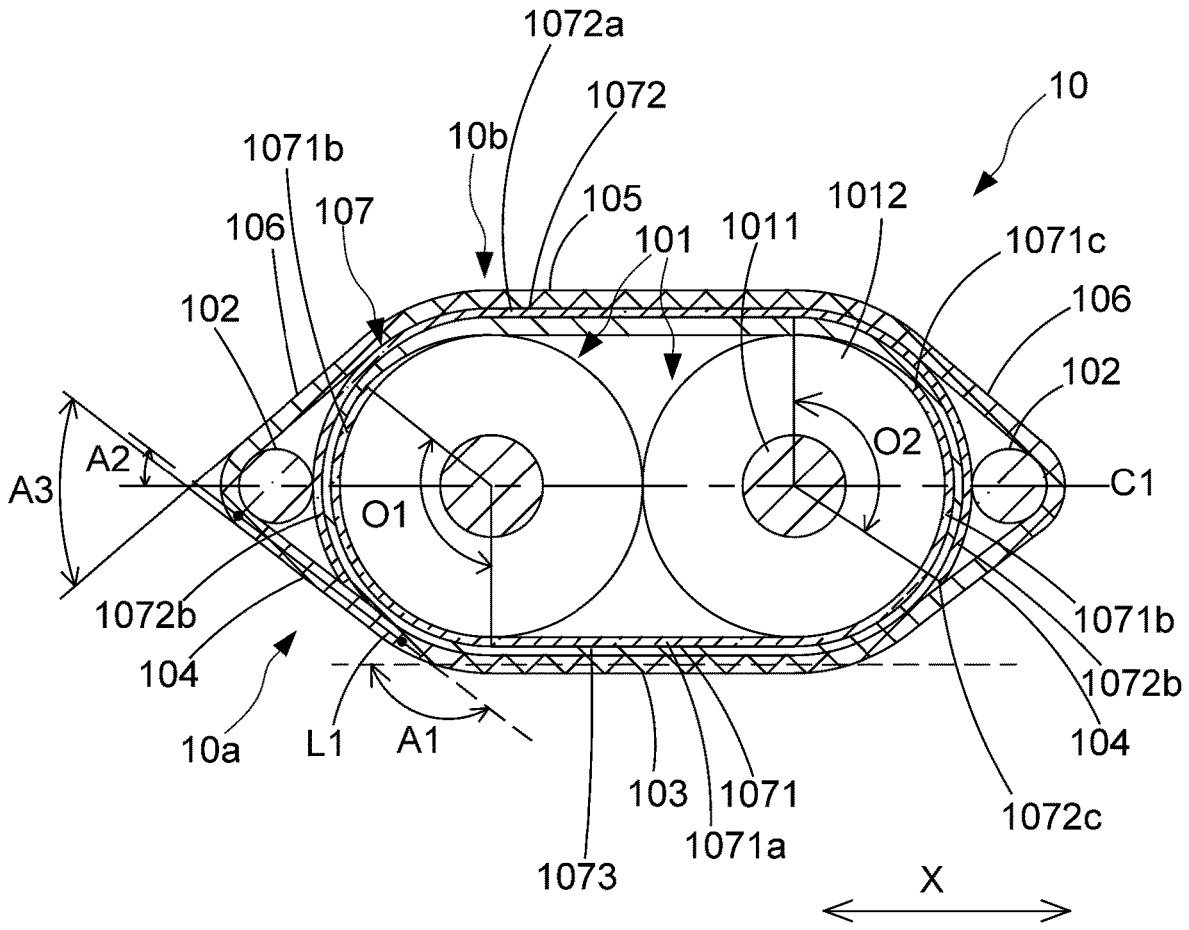
FIG. 2 is a schematic view of the first embodiment of a cable of the present application.

Referring to FIGS. 1 and 2, a flat cable assembly of the present embodiment includes a plurality of cables 10 and an insulating film 11. The cables 10 are arranged in a row along a horizontal direction X. In the present embodiment, the cables are located in the same horizontal plane. The plurality of cables 10 have a central line C parallel to the horizontal direction X. Each cable 10 has a first central line C1 parallel with the horizontal direction X. When the cables 10 are arranged in a row along the horizontal direction X, the first central line C1 of each cables 10 is aligned with the first central line C1 of the adjacent cable 10, and the first central lines C1 of all cables 10 are connected to form the central line C. Each of the cables 10 has a first connecting portion 10*a* and a second connecting portion 10*b*. The first connecting portion 10*a* and the second connecting portion 10*b* are symmetrical. The first connecting portions 10*a* of the cables 10 are disposed on one side of the central line C, and the second connecting portions 10*b* of the cables 10 are disposed on the other side of the central line C. In the present embodiment, the first connecting portions 10*a* of the cables 10 are disposed on a lower side of the central line C, and the second connecting portions 10*b* of the cables 10 are disposed on an upper side of the central line C. Each of cables 10 includes signal wires 101 and grounding wires 102. The insulating film 11 is disposed on the first connecting portions 10*a* and the second connecting portions 10*b*, that is the insulating film 11 enclose the cables 10, whereby the cables 10 are serially connected to form the flat cable assembly 1.

As the grounding wires 102 of the present embodiment are disposed within each cable 10, the protrusions on both lateral sides of the insulating film 11 for securing the grounding wires 102 are unnecessary. In addition, the insulating film 11 has two surfaces, which are planes, opposite located in a direction perpendicular to the central line C (an upper surface and a lower surface of the insulating film 11) to facilitate the connection and securing of the flat cable assembly 1 to an equipment.

Specifically, the first connecting portion 10*a* of each cable 10 has a first surface 103 parallel with the horizontal direction X and two second surfaces 104 symmetrically disposed on two sides of the first surface 103. The line L1 extending through two lateral sides of the second surface 104 with the shortest distance is inclined with respect to an extending line along the first surface 103 (the horizontal direction X) and has an angle A1 greater than 90 degree with respect to the extending line along the first surface 103. The line L1 extending through two lateral sides of the second surface 104 with the shortest distance has an angle A2 less than 90 degree with respect to the first central line C1 (the central line C of the plurality of cables 10). The second surface 104 of the present embodiment is a plane and coincides with the line L1 extending through two lateral sides of the second surface 104 with the shortest distance, that is the angle between the first surface 103 and the second surface 104 is greater than 90 degree. The first connecting portion 10*a* and the second connecting portion 10*b* of each cable 10 are symmetrically disposed with respect to the first central line C1. Each second connecting portion 10*b* has a third surface 105 and two four surfaces 106. The four surfaces 106 are symmetrically disposed on two sides of the third surface 105. The third surface 105 and the first surface 103 are symmetrical with respect to the first central line C1 (the central line C of the plurality of cables 10) and parallel with the horizontal direction. The both four surfaces 106 and the both second surfaces 104 are symmetrically disposed with respect to the first central line C1 (the central line C of the plurality of cables 10), and the angle A3 between the second surface 104 and the adjacent four surface 106 is less than 180 degree.

Figure 3:
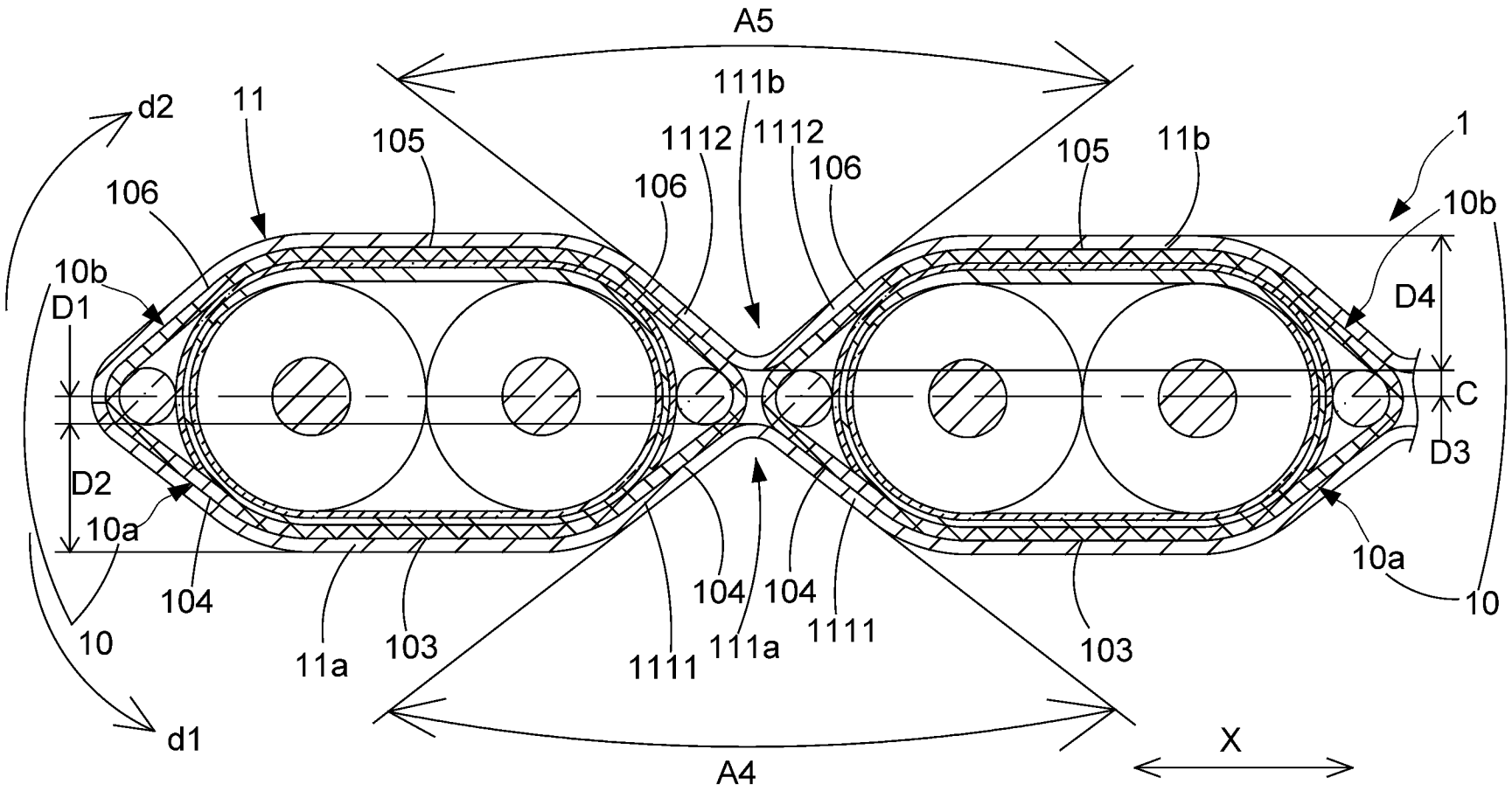
FIG. 3 is a partially schematic view of the first embodiment of a flat cable of the present application.

Referring to FIG. 3, when the insulating film 11 is disposed on the first connecting portion 10*a* and the second connecting portion 10*b*, the insulating film covers the first surface 103 and the second surfaces 104 of the first connecting portion 10*a*, and also covers the third surface 105 and the fourth surfaces 106 of the second connecting portion 10*b*. The insulating film 11 has a plurality of first connecting concave portions 111*a* and a plurality of second connecting concave portions 111*b*. The first connecting concave portions 111*a* are located between the first connecting portions 10*a* of the cables 10, and the second connecting concave portions 111*b* are located between the second connecting portions 10*b* of the cables 10. In the present embodiment, each first connecting concave portion 111*a* is located between two adjacent first connecting portions 10*a* and covers the second surfaces 104. A minimum distance D1 between a bottom of the first connecting concave portions 111*a* and the central line C the cables 10 is smaller or equal to half a minimum distance D2 between the first surface 103 and the central line C of the cables 10. Similarly, each second connecting concave portion 111*b* is located between two adjacent second connecting portions 10*b* and covers the four surfaces 106. A minimum distance D3 between a bottom of the second connecting concave portions 111*b* and the central line C of the cables 10 is smaller or equal to half a minimum distance D4 between the third surface 105 and the central line C of the cables 10, whereby the contact area of the insulating film 11 and the cables 10 is increased so as to increase the reliability and stability of the connection of the insulating film 11 and the cables 10.

The first connecting concave portions 111*a* and the second connecting concave portions 111*b* may have a cross section of triangle, trapezoid or rectangle. The first connecting concave portions 111*a* and the second connecting concave portions 111*b* of the present embodiment have a cross section of triangle, thereby increasing the curvature of the flat cable 1.

In the present embodiment, the insulating film 11 includes a first insulating layer 11*a* and a second insulating layer 11*b*. The first insulating layer 11*a* is disposed on the first connecting portions 10*a* of the cables 10. The first insulating layer 11*a* covers the first surface 103 and the second surfaces 104 of each first connecting portion 10*a* and is located on one side of the central line C. The second insulating layer 11*b* is disposed on the second connecting portions 10*b* of the cables 10. The second insulating layer 11*b* covers the third surface 105 and the fourth surfaces 106 of each second connecting portion 10*b* and is located on the other side of the central line C. The opposite sides of the first insulating layer 11*a* connect the opposite sides of the second insulating layer 11*b* respectively, whereby the first insulating layer 11*a* and the second insulating layer 11*b* cover the cables 10 to facilitate the mounting structure of the insulating film 11 on the cables 10. A connection position of the first insulating layer 11*a* and the second insulating layer 11*b* are located between the first connecting portion 10*a* and the second connecting portion 10*b* of the cable 10 located in the outermost position, thereby preventing the connection position from being located in a direction perpendicular to the central line C, and two surfaces of the insulating film 11 in the direction perpendicular to the central line C are plane to facilitate the assembly of the equipment. The connection of opposite sides of the Care first insulating layer 11*a* and the second insulating layer 11*b* also means no protrusion presented at the connection position of the first insulating layer 11*a* and the second insulating layer 11*b*.

Referring to FIG. 3, each of the first connecting concave portions 111*a* has two opposite first connecting lateral walls 1111 connected to the both adjacent second surfaces 104, and each of the second connecting concave portions 111*b* has two opposite second connecting lateral walls 1112 connected to the both adjacent fourth surface 106. The both first connecting lateral walls 1111 of the first connecting concave portions 111*a* are diagonally opposite to the second connecting lateral walls 1112 of the second connecting concave portions 111*b* respectively. The insulating film 11 can be flexible or rigid. In case that the insulating film 11 is flexible, the both first connecting lateral walls 1111 of the first connecting concave portions 111*a* have a first variable angle A4 therebetween, and the both second connecting lateral walls 1112 of the second connecting concave portions 111*b* have a second variable angle A5 therebetween. When the flat cable 1 is bent toward a first direction d1, the both first connecting lateral walls 1111 of the first connecting concave portions 111*a* move toward each other, whereby the first variable angle A4 becomes smaller, but the both second connecting lateral walls 1112 of the second connecting concave portions 111*b* move away from each other, whereby the second variable angle A5 becomes larger. When the flat cable 1 is bent toward a second direction d2, the both first connecting lateral walls 1111 of the first connecting concave portions 111*a* move away from each other, whereby the first variable angle A4 becomes larger, but the both second connecting lateral walls 1112 of the second connecting concave portions 111*b* move toward each other, whereby the second variable angle A5 becomes smaller. In case that the insulating film 11 is rigid, the diagonally-disposed first connecting lateral walls 1111 and second connecting lateral walls 1112 are mutually parallel.

The detailed structure is described as follows. Referring to FIG. 2 again, the cable 10 further includes an electrically conductive layer 107 and an insulating enclosing layer 108. Each of the cables 10 includes two signal wires 101. The both signal wires 101 are arranged along the horizontal direction X and abut each other. The electrically conductive layer 107 encloses the signal wires 101. Each of the cables 10 includes two grounding wires 102 disposed on two sides of the electrically conductive layer 107 and contacting the electrically conductive layer 107. The insulating enclosing layer 108 encloses the grounding wires 102 and the electrically conductive layer 107 enclosing the signal wires 101. The centers of the signal wires 101 and the centers of the grounding wires 102 are arranged in a row along the horizontal direction X and located at the first central line C1 (the central line C of the cables 10).

The electrically conductive layer 107 of the present embodiment includes a first conductive film 1071 and a second conductive film 1072 on an inner surface thereof. The first conductive film 1071 is located at an inner side of the second conductive film 1072. The first conductive film 1071 and the second conductive film 1072 are opposite disposed. The first conductive film 1071 and the second conductive film 1072 surround the signal wires 101, and the grounding wires 102 contact the second conductive film 1072. The first conductive film 1071 of the present embodiment includes a first covering portion 1071*a* and two first enclosing portions 1071*b* located at two sides of the first covering portion 1071*a*, and a first notch 1071*c* corresponding to the first covering portion 1071*a* is formed between the first enclosing portions 1071*b*. The second conductive film 1072 includes a second covering portion 1072*a* and two second enclosing portions 1072*b* located at two sides of the second covering portion 1072*a*, and a second notch 1072*c* corresponding to the second covering portion 1072*a* is formed between the second enclosing portions 1072*b*.

The first conductive film 1071 and the second conductive film 1072 are opposite disposed, and the first conductive film 1071 is disposed within the second conductive film 1072. The first covering portion 1071*a* is closer to second notch 1072*c* than the both first enclosing portions 1071*b*. The both first enclosing portions 1071*b* is closer to second covering portion 1072*a* than the first covering portion 1071*a*. The second covering portion 1072*a* covers the first notch 1071*c*, and the first enclosing portions 1071*b* partially overlap the second enclosing portions 1072*b* respectively. Therefore, the first conductive film 1071 and the second conductive film 1072 enclose the both signal wires 101, whereby the signals transmitted in both signal wires 101 of each cable 10 interfere the signals transmitted in the signal wires 101 of the adjacent cable 10, and thus the flat cable assembly 1 has an excellent effect on EMI shielding and promoted signal transmitting performance. The first enclosing portions 1071*b* are circular arced, and the center of the first enclosing portions 1071*b* overlaps the center of the adjacent signal wire 101. The first enclosing portions 1071*b* has a central angle 01 ranging from 10° to 180°; the second enclosing portions 1072*b* are circular arced, and the center of the second enclosing portions 1072*b* overlap the center of the adjacent signal wire 101. The second enclosing portion 1072*b* has a central angle ranging from 10° to 180°.

The electric conductive layer 107 further includes an insulating spacing film 1073 disposed between the first conductive film 1071 and the second conductive film 1072. In other word, the first conductive film 1071 disposed on a surface of the insulating spacing film 1073 in the vicinity of the signal wire 101, and the second conductive film 1072 is disposed on a surface of the insulating spacing film 1073 in the vicinity of the grounding wire 10, whereby the or first conductive film 1071 and the second conductive film 1072 are secured and spaced by the insulating spacing film 1073. The first conductive film 1071 and the second conductive film 1072 are made by metal, which is selected from a group consisting of aluminum, copper, lead and tin.

The signal wire 101 of the present embodiment includes a signal conductor 1011 and an insulating layer 1012 enclosing a peripheral surface of the signal conductor 1011, and two axial ends of the signal conductor 1011 may reveal from the insulating layer 1012. The signal conductor 1011 is a slender cylinder or weaved by a plurality of conductive wires. The signal conductor 1011 is made of metal, which is selected from a group consisting of copper, aluminum, tin, nickel, silver and gold. That is the signal conductor 1011 can be made of an alloy made by the aforementioned metal elements or formed by a metal substrate coated with the aforementioned metal elements, such as tin-copper coating or silver-copper coating. The insulating layer 1012 is a non-conductive tape made of polyester material. The tape is spirally wound on the peripheral surface of the signal conductor 1011, and the tape is fixed on the signal conductor 1011 with glue; or the insulating layer 1012 is formed on the peripheral surface of the signal conductor 1011 by coating with polyester material. The polyester material is selected from a group consisting of polyvinyl chloride, polyethylene, polypropylene, and copolymer of fluorinated ethylene and propylene. The grounding wire 102 has a grounding conductor, which is a slender cylinder or weaved by a plurality of conductive wires. The grounding conductor is made of metal, which is selected from a group consisting of copper, aluminum, tin, nickel, silver and gold.

The cable 10 of the present embodiment includes two signal wires 101 for form a differential signal pair. That also means that the cable 10 of the present embodiment transmits differential signals with the differential signal pair, whereby the interfere energy of the adjacent signal wires 101 cancel each other during the signal transmission to promote the ability in anti-EMI and the signal transmission performance.

Figure 4:
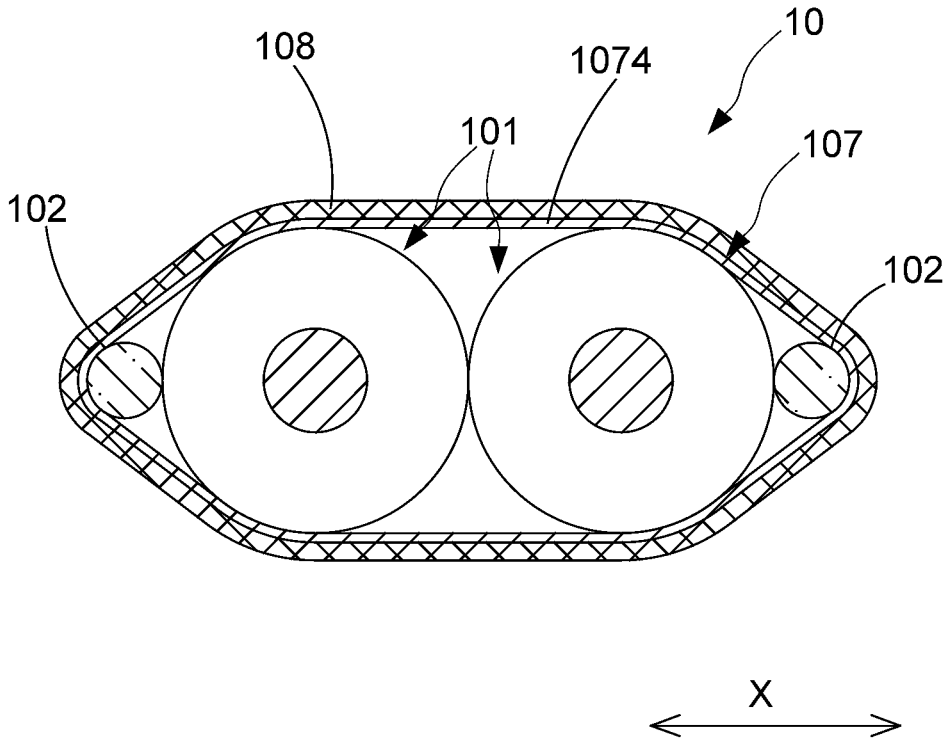
FIG. 4 is a schematic view of the second embodiment of a cable of the present application.

Referring to FIG. 4, the second embodiment of the cable is illustrated. The cable 10 of the present embodiment differs from the previous embodiment in that the both grounding wires 102 are disposed within the electrically conductive layer 107, and the both grounding wires 102 are disposed on two sides of the signal wires 101, and the center of the both signal wire 101 and the center of the both grounding wire 102 are arranged in a row along the horizontal direction X. The electrically conductive layer 107 encloses the both signal wires 101 and the both grounding wires 102. The both grounding wires 102 contact the electrically conductive layer 107. The electrically conductive layer 107 of the present embodiment includes an electrically conductive layer 1074. The electrically conductive layer 1074 is made of metal, which is selected from a group consisting of aluminum, copper, lead and tin. The insulating enclosing layer 108 directly encloses the electrically conductive layer 107. The cable of the first embodiment can be replaced by the cable 10 of the present embodiment.

Figure 5:
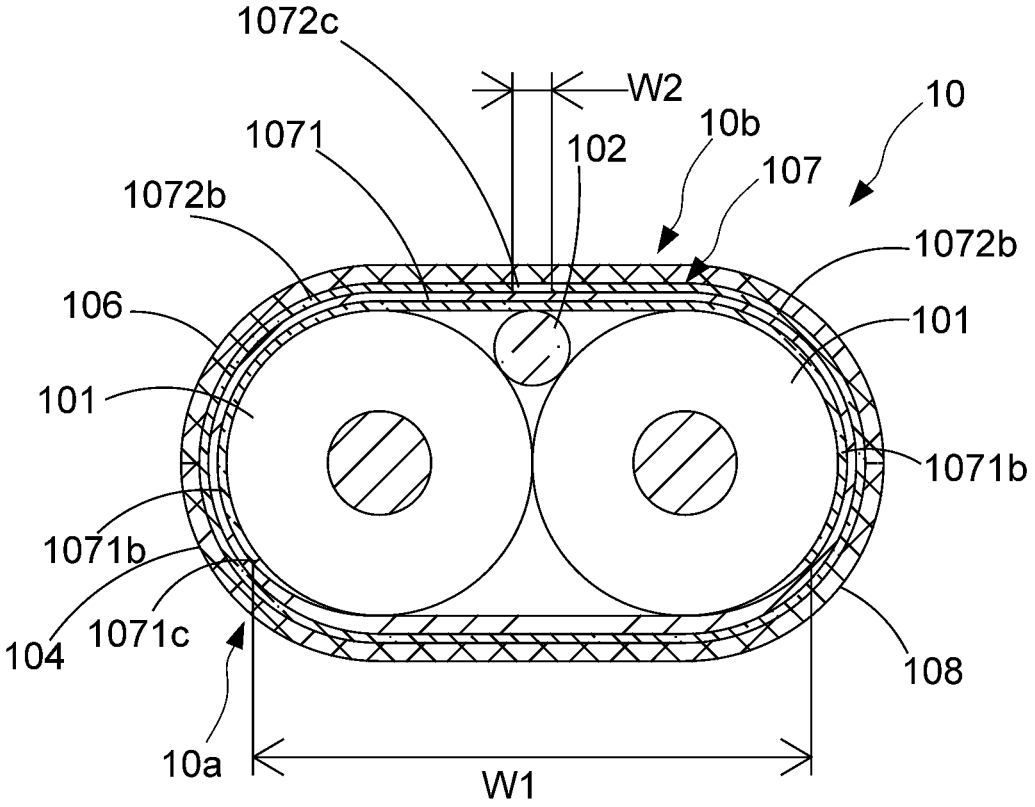
FIG. 5 is a schematic view of the third embodiment of a cable of the present application.

Referring to FIG. 5, the third embodiment of the cable is illustrated. The cable 10 of the present embodiment differs from the previous embodiments in that only one grounding wire 102 is presented, and the grounding wire 102 is located within the electrically conductive layer 107. The grounding wire 102 is disposed between the both signal wires 101 and contacts the both signal wires 101. The electrically conductive layer 107 encloses two signal wires 101 and the grounding wire 102. The grounding wire 102 contacts the first conductive film 1071 of the electrically conductive layer 107. The first conductive film 1071 has a structure the same as the first conductive film of the electrically conductive layer of the first embodiment.

The second conductive film 1072 of the electrically conductive layer 107 of the present embodiment has a structure different from the second conductive film of the first embodiment. As for the second conductive film 1072 of the present embodiment, the both second enclosing portions 1072*b* have two very close ends located in positions away from the second enclosing portion 1072*b*, that is the width W2 of the second notch 1072*c* is far less than the width W1 of the first notch 1071*c*, whereby the overlapping area of the first conductive film 1071 and the second conductive film 1072 is increased to ensure that the first conductive film 1071 and the second conductive film 1072 completely enclose the both signal wires 101, and thus the flat cable assembly 1 has an excellent effect on EMI shielding and a promoted performance in signal transmission. The insulating enclosing layer 108 directly encloses the electrically conductive layer 107. The second surface 104 of the first connecting portion 10*a* and the fourth surface 106 of the second connecting portion 10*b* are circular arced. The fourth surface 104 does not coincide with the shortest line extending through two lateral sides of the second surface 104. The fourth surface 106 and the second surface 104 are symmetrical so that the fourth surface 106 does not coincide with the shortest line extending through two lateral sides of the second surface 106. The cable of the first embodiment can be replaced by the cable 10 of the present embodiment.

In summary, this application provides a flat cable assembly. The grounding wire is integrated into each cable, whereby the two lateral sides of the insulating film does not extend outward, and thus the manufacture of flat cable assembly is effectively simplified The flat cable assembly of the present disclosure has an excellent effect on EMI shielding and an excellent performance in signal transmission. The insulating film of this application is formed by connection of two insulating film layers. The both insulating film layers are joined at both sides of the plurality of cables. The insulating film has two planes in a direction perpendicular to the center line. When the flat cable assembly of the application is connected to an equipment, the flat cable assembly is easy to be fixed on the equipment and occupies no space of the equipment. In addition, the insulating film of the present application has a plurality of first connection concave portions and a plurality of second connection concave portions, and the insulating film covers the first surface and the both second surfaces of each first connection portion and the third surface and the both fourth surfaces of the second connection portion, whereby the contact area between the insulating film and the multiple cables is effectively increased, and the stability of the connection between the insulating film and the cables is promoted.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

It is to be understood that the term "comprises", "comprising", or any other variants thereof, is intended to encompass a non-exclusive inclusion, such that a process, method, article, or device of a series of elements not only includes those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. A flat cable assembly, comprising:

a plurality of cables arranged in a row and having a central line, wherein each of the cables has a first connecting portion, a second connecting portion symmetrical with the first connecting portion, a signal wire and a grounding wire, the first connecting portion is located on one side of the central line, and the second connecting portion is located on the other side of the central line; and an insulating film disposed on the first connecting portion and the second connecting portion of one of the cables, wherein the insulating film has two sides without protruding from outermost ones of the cables, and has two flat surfaces having a normal line perpendicular to the central line;

wherein each of the cables comprises two signal wires, two grounding wires, an electrically conductive layer and an insulating enclosing layer, the both signal wires abut each other, the electrically conductive layer encloses the both signal wires, the grounding wires are disposed on two outer sides of the electrically conductive layer and contacts the electrically conductive layer, the insulating enclosing layer encloses the grounding wires and the electrically conductive layer enclosing the signal wires, the signal wires have centers located at the central line, and the grounding wires have centers located at the central line.

2. The flat cable assembly according to claim 1, wherein the first connecting portion has a first surface and two second surfaces, the second connecting portion has a third surface and two fourth surfaces, the first surface and the third surface are symmetrical with respect to the central line, the second surfaces and the fourth surfaces are symmetrical with respect to the central line, the insulating film comprises a plurality of first connecting concave portions disposed on the adjacent second surfaces respectively, and a plurality of second connecting concave portions disposed on the adjacent fourth surfaces respectively.

3. The flat cable assembly according to claim 2, wherein a minimum distance between any one of the first connecting concave portions and the central line is smaller or equal to half a minimum distance between the first surface and the central line, and a minimum distance between any one of the second connecting concave portions and the central line is smaller or equal to half a minimum distance between the first surface and the central line.

4. The flat cable assembly according to claim 2, wherein any one of the first connecting concave portions has a cross section of triangle, trapezoid or rectangle; any one of the second connecting concave portions has a cross section of triangle, trapezoid or rectangle.

5. The flat cable assembly according to claim 2, wherein each of the first connecting concave portions has two first connecting lateral walls, each of the second connecting concave portions has two second connecting lateral walls diagonally opposite to the first connecting lateral walls respectively.

6. The flat cable assembly according to claim 5, wherein the insulating film is flexible, the both first connecting lateral walls have a first variable angle therebetween, and the both second connecting lateral walls have a second variable angle therebetween.

7. The flat cable assembly according to claim 5, wherein the insulating film is rigid, the first connecting lateral walls are parallel to the corresponding second connecting lateral walls respectively.

8. The flat cable assembly according to claim 1, wherein the insulating film comprises a first insulating layer and a second insulating layer, the first insulating layer is disposed on the first connecting portion of any one of the cables and located on one side of the central line, the second insulating layer is disposed on the second connecting portion of any one of the cables and located on the other side of the central line, the first insulating layer is connected to the second insulating layer at two lateral edges thereof, and a connection position of the first insulating layer and the second insulating layer are located between the first connecting portion and the second connecting portion.

9. The flat cable assembly according to claim 1, wherein the electric conductive layer comprises a first conductive film and a second conductive film, the first conductive film is located at an inner side of the second conductive film, the first conductive film partially overlaps the second conductive film, the first conductive film and the second conductive film surround the signal wires, and the grounding wires contact the second conductive film.

10. The flat cable assembly according to claim 9, wherein the first conductive film comprises a first covering portion and two first enclosing portions located at two sides of the first covering portion, a first notch corresponding to the first covering portion is formed between the first enclosing portions; the second conductive film comprises a second covering portion and two second enclosing portions located at two sides of the second covering portions, a second notch corresponding to the second covering portion is formed between the second enclosing portions, the second covering portion covers the first notch, and the both first enclosing portions partially overlap the both second enclosing portions respectively.

11. The flat cable assembly according to claim 10, wherein the first enclosing portions are circular arced, any one of the first enclosing portions has a central angle ranging from 10° to 180°; the second enclosing portions are circular arced, any one of the second enclosing portions has a central angle ranging from 10° to 180°.

12. The flat cable assembly according to claim 10, wherein the electric conductive layer further comprises an insulating spacing film disposed between the first conductive film and the second conductive film.

13. A flat cable assembly, comprising:

a plurality of cables arranged in a row and having a central line, wherein each of the cables has a first connecting portion, a second connecting portion symmetrical with the first connecting portion, a signal wire and a grounding wire, the first connecting portion is located on one side of the central line, and the second connecting portion is located on the other side of the central line; and an insulating film disposed on the first connecting portion and the second connecting portion of one of the cables, wherein the insulating film has two sides without protruding from outermost ones of the cables, and has two flat surfaces having a normal line perpendicular to the central line;

wherein each of the cables comprises two signal wires, an and an insulating enclosing layer, the signal wires are adjacent, the grounding wires are disposed between the signal wires, the electric conductive layer encloses the signal wires and the grounding wires, the grounding wires contact the electric conductive layer, and the insulating enclosing layer encloses the electric conductive layer.

14. The flat cable assembly according to claim 13, wherein the electric conductive layer comprises a first conductive film and a second conductive film, the first conductive film is located at an inner side of the second conductive film, the first conductive film partially overlaps the second conductive film, the first conductive film and the second conductive film surround the signal wires, and the grounding wires contact the first conductive film.

15. The flat cable assembly according to claim 14, wherein the first conductive film comprises a first covering portion and two first enclosing portions located at two sides of the first covering portion, a first notch corresponding to the first covering portion is formed between the first enclosing portions; the second conductive film comprises a second covering portion and two second enclosing portions located at two sides of the second covering portions, a second notch corresponding to the second covering portion is formed between the second enclosing portions, the second covering portion covers the first notch, and the both first enclosing portions partially overlap the both second enclosing portions respectively.

16. The flat cable assembly according to claim 15, wherein the first enclosing portions are circular arced, any one of the first enclosing portions has a central angle ranging from 10° to 180°; the second enclosing portions are circular arced, any one of the second enclosing portions has a central angle ranging from 10° to 180°.

17. The flat cable assembly according to claim 15, wherein the electric conductive layer further comprises an insulating spacing film disposed between the first conductive film and the second conductive film.

* * * * *